US008348257B2

(12) United States Patent
Chen et al.

(10) Patent No.: US 8,348,257 B2
(45) Date of Patent: Jan. 8, 2013

(54) RETARD ROLLER AND RETARD ROLLER MODULE HAVING SUCH RETARD ROLLER

(75) Inventors: Yi-Liang Chen, Taipei (TW); Ping-Hung Kuo, Taipei (TW); Chien-Kuo Kuan, Taipei (TW)

(73) Assignee: Primax Electronics Ltd., Taipei (TW)

( * ) Notice: Subject to any disclaimer, the term of this patent is extended or adjusted under 35 U.S.C. 154(b) by 16 days.

(21) Appl. No.: 13/191,964

(22) Filed: Jul. 27, 2011

(65) Prior Publication Data

US 2011/0278788 A1 Nov. 17, 2011

Related U.S. Application Data

(62) Division of application No. 12/725,184, filed on Mar. 16, 2010, now Pat. No. 8,066,274.

(30) Foreign Application Priority Data

Dec. 25, 2009 (TW) ..... 98144971 A

(51) Int. Cl.
*B65H 3/52* (2006.01)
*B65H 3/32* (2006.01)
*B65H 3/06* (2006.01)

(52) U.S. Cl. ..... 271/121; 271/113; 271/114; 271/116

(58) Field of Classification Search ..... 271/121, 271/122, 113, 114–118; 464/40, 57; 192/56.2, 192/55.1, 55.5
See application file for complete search history.

(56) References Cited

U.S. PATENT DOCUMENTS

| | | | | |
|---|---|---|---|---|
| 2,595,454 | A * | 5/1952 | Greenlee | 464/40 |
| 3,128,864 | A | 4/1964 | Hungerford et al. | |
| 3,450,365 | A * | 6/1969 | Kaplan | 242/412.1 |
| RE33,514 | E * | 1/1991 | Ciolli | 192/48.92 |
| 7,384,034 | B2 * | 6/2008 | Nagura et al. | 271/125 |
| 7,448,611 | B2 | 11/2008 | Chang | |
| 7,708,267 | B2 | 5/2010 | Shigeno | |
| 2002/0171193 | A1 * | 11/2002 | Asai et al. | 271/121 |
| 2002/0175462 | A1 | 11/2002 | Sonoda et al. | |
| 2004/0012143 | A1 * | 1/2004 | Yamamoto | 271/272 |
| 2005/0189701 | A1 * | 9/2005 | Nagura et al. | 271/167 |
| 2008/0251992 | A1 * | 10/2008 | Mo et al. | 271/127 |

FOREIGN PATENT DOCUMENTS

JP 2003081471 A * 3/2003

* cited by examiner

*Primary Examiner* — Patrick Cicchino
(74) *Attorney, Agent, or Firm* — Kirton McConkie; Evan R. Witt

(57) ABSTRACT

A retard roller of an automatic document feeder provides a frictional force to separate plural documents from each other. The retard roller can provide a first damping torque and a second damping torque with different directions. The second damping torque is smaller than the first damping torque. As such, the frictional force exerted on the document is reduced for returning the document out of the automatic document feeder. A retard roller module having such a retard roller is also provided.

6 Claims, 9 Drawing Sheets

RETARD ROLLER AND RETARD ROLLER MODULE HAVING SUCH RETARD ROLLER

CROSS-REFERENCE TO RELATED APPLICATION

This is a divisional application of application Ser. No. 12/725,184, filed Mar. 16, 2010, which is incorporated by reference

FIELD OF THE INVENTION

The present invention relates to a retard roller, and more particularly to a retard roller for use in an automatic document feeder.

BACKGROUND OF THE INVENTION

In the early stage, a scanning apparatus is used to scan the image of a single document. For scanning both sides of the document, the document should be manually turned over after one side of the document has been scanned in order to sequentially scan the other side of the document. For scanning a stack of documents, after one document has been scanned, the document should be removed from the scanning apparatus and then a next document could be placed on the scanning apparatus in order to be further scanned. Since the process of manually turning over the document or manually replacing the document is very troublesome, the conventional scanning apparatus is not feasible. Recently, an automatic document feeder is usually integrated into the scanning apparatus. The automatic document feeder is suitable to perform a duplex scanning operation and successively scan plural documents without the need of manually turning over or replacing the documents.

Generally, the automatic document feeder has a sheet input tray for placing a stack of documents. The automatic document feeder also has a sheet pick-up module for successively feeding the stack of documents from the sheet input tray to the internal portion of the automatic document feeder in a sheet-feeding direction. For allowing only one document to be fed into the internal portion of the automatic document feeder at each feeding time, the sheet pick-up module has a sheet separation roller and a separation pad. The separation pad is disposed under the sheet separation roller. The sheet separation roller may provide a frictional force to the document that is contacted with the separation pad. The frictional forces between the sheet pick-up module, the separation pad and the documents should be elaborately controlled. Generally, the frictional force between the sheet pick-up module and the document contacted with the sheet pick-up module is greater than the frictional force between the documents. In addition, the frictional force between the separation pad and the document contacted with the separation pad is also greater than the frictional force between the documents. As a consequence, only one document is allowed to be fed into the internal portion of the automatic document feeder at each feeding time. As the automatic document feeder is used for a long time, the separation pad is usually abraded, or even losses the function of separating documents. In this situation, the separation pad needs to be replaced with a new one. Since the separation pad is usually securely fastened on the automatic document feeder, the process of replacing the separation pad is very complicated.

For solving the above drawbacks, U.S. Pat. No. 6,659,450 disclosed an automatic document feeder with an easily disassembled separation pad and retard roller. During the sheet-feeding process, the retard roller generates a damping torque in a sheet-feeding rotating direction. In response to the damping torque, the retard roller provides a frictional force to the document. Although the separation pad and the retard roller of the automatic document feeder described in U.S. Pat. No. 6,659,450 are disassembled more easily when compared with the prior art, there are still some drawbacks. For example, after the retard roller is disassembled, the spring for providing a normal force on the retard roller is still retained in the automatic document feeder. During the process of assembling the retard roller, the retard roller needs to be installed in the automatic document feeder while aligning the retard roller with the spring. In other words, the retard roller needs to be precisely combined with the spring in order to achieve a normal function of the retard roller. The process of assembling the retard roller is not user-friendly.

Moreover, in a case that the documents are jammed in the internal portion of the automatic document feeder, the installation of the retard roller or separation pad incurs some drawbacks. For example, due to the frictional force between the jammed documents and the retard roller (or separation pad), the jammed documents fail to be pulled out of the automatic document feeder in a sheet-returning direction, which is opposed to the sheet-feeding direction. For releasing the jammed documents, the user needs to open the upper cover of the automatic document feeder to uplift the sheet pick-up module. As such, the sheet pick-up module is separated from the upper sides of the jammed documents and the frictional force between the jammed documents and the retard roller (or separation pad) is eliminated. Meanwhile, the jammed documents could be effectively released.

Since the process of removing the document from the automatic document feeder is very troublesome, there is a need of providing a retard roller for moving the document in the sheet-feeding direction and the sheet-returning direction without the need of opening the upper cover.

SUMMARY OF THE INVENTION

An object of the present invention provides a retard roller for moving the document in the sheet-feeding direction and the sheet-returning direction.

Another object of the present invention provides an easily disassembled/assembled retard roller module.

In accordance with an aspect of the present invention, there is provided a retard roller of an automatic document feeder for providing a frictional force to separate a first document and a second document from each other. The first document lies on the second document. The retard roller includes a sleeve, a separation pad, a helical spring and a rotating shaft. The sleeve has a sleeve inner wall. The separation pad is sheathed around the sleeve, and contacted with the second document. The helical spring is disposed within the sleeve, and includes a first spring segment and a second spring segment. The first spring segment has a first spring inner diameter. The second spring segment has a second spring inner diameter smaller than the first spring inner diameter. The first spring segment is contacted with the sleeve inner wall. The rotating shaft is penetrated through the helical spring and contacted with the second spring segment. When the second document is moved in a first direction, the sleeve is rotated in a first rotating direction, the first spring segment is twisted in the first rotating direction, and the first spring inner diameter of the first spring segment is widened, so that the first spring segment is fixed on the sleeve inner wall and the second spring segment is twisted with respect to the rotating shaft to generate a first damping torque. After the first spring inner diameter of the first spring segment is widened and the second document is moved in a second direction opposed to the first direction, the sleeve is rotated in a second rotating direction, so that the second spring segment is fixed on the rotating shaft and the first spring segment is twisted to generate a second damping torque. The first damping torque is greater than the second damping torque.

In an embodiment, the sleeve inner wall includes a first inner wall part and a second inner wall part. The first inner wall part is near a first end of the sleeve, and has a first sleeve inner diameter. The second inner wall part is near a second end of the sleeve, and has a second sleeve inner diameter. The first sleeve inner diameter is smaller than the second sleeve inner diameter.

In an embodiment, the sleeve inner wall is an inclined wall.

In an embodiment, the first spring segment is contacted with the first inner wall part. The second spring segment is separated from the second inner wall part but contacted with the rotating shaft. When the sleeve is rotated in the first rotating direction, the first spring segment is twisted in the first rotating direction, and the first spring inner diameter of the first spring segment is widened, so that the first spring segment is fixed on the first inner wall part and the second spring segment is twisted with respect to the rotating shaft to generate the first damping torque. After the first spring inner diameter of the first spring segment is widened and the second document is moved in the second direction, the sleeve is rotated in the second rotating direction, so that the second spring segment is fixed on the rotating shaft and the first spring segment is twisted to generate the second damping torque.

In an embodiment, the first spring segment is eccentrically connected with the second spring segment.

In an embodiment, the retard roller further includes a receiving shaft inserted into the first end of the sleeve. The rotating shaft is inserted into the second end of the sleeve and received within the receiving shaft.

In accordance with another aspect of the present invention, there is provided a retard roller of an automatic document feeder for providing a frictional force to separate a first document and a second document from each other. The first document lies on the second document. The retard roller includes a first sleeve, a second sleeve, a separation pad, a helical spring, a one-way clutch and a rotating shaft. The first sleeve has a sleeve inner tube. The second sleeve is accommodated within the first sleeve, and has a sleeve outer tube. The sleeve outer tube is arranged at an end of the second sleeve and contacted with an end of the sleeve inner tube. The separation pad is sheathed around the first sleeve, and contacted with the second document. The helical spring is accommodated within the first sleeve. A first end of the helical spring is sheathed around the sleeve outer tube to define a first spring segment. A second end of the helical spring is sheathed around the sleeve inner tube to define a second spring segment. The first spring segment has a first spring inner diameter. The second spring segment has a second spring inner diameter smaller than the first spring inner diameter. The one-way clutch is accommodated within the second sleeve for preventing the second sleeve from rotating in a first rotating direction. The rotating shaft is penetrated through the first sleeve, the second sleeve and the one-way clutch. When the second document is moved in a first direction, the first sleeve is rotated in the first rotating direction, and the second sleeve fails to be rotated in response to the one-way clutch, so that the first spring segment is fixed on the sleeve outer tube and the second spring segment is twisted with respect to the sleeve inner tube to generate a first damping torque. When the second document is moved in a second direction opposed to the first direction, the first sleeve is rotated in a second rotating direction, the first spring segment is fixed on the sleeve outer tube, and the second spring segment is fixed on the sleeve inner tube, so that the second sleeve is rotated with the first sleeve and the one-way clutch is rotated with respect to the rotating shaft to generate a second damping torque. The first damping torque is greater than the second damping torque.

In an embodiment, a tube diameter of the sleeve inner tube is smaller than that of the sleeve outer tube, so that the interference between the first spring segment and the sleeve outer tube is greater than the interference between the second spring segment and the sleeve inner tube.

In accordance with a further aspect of the present invention, there is provided a retard roller module of an automatic document feeder. The retard roller module has a retard roller for providing a frictional force to separate a first document and a second document from each other. The first document lies on the second document. The retard roller module includes a retard roller frame, the retard roller and an elastic element. The retard roller is installed on the retard roller frame. The retard roller includes a sleeve, a separation pad, a helical spring and a rotating shaft. The sleeve has a sleeve inner wall. The separation pad is sheathed around the sleeve, and contacted with the second document. The helical spring is disposed within the sleeve, and includes a first spring segment and a second spring segment. The first spring segment has a first spring inner diameter. The second spring segment has a second spring inner diameter smaller than the first spring inner diameter. The first spring segment is contacted with the sleeve inner wall. The rotating shaft is penetrated through the helical spring and contacted with the second spring segment. When the second document is moved in a first direction, the sleeve is rotated in a first rotating direction, the first spring segment is twisted in the first rotating direction, and the first spring inner diameter of the first spring segment is widened, so that the first spring segment is fixed on the sleeve inner wall and the second spring segment is twisted with respect to the rotating shaft to generate a first damping torque. After the first spring inner diameter of the first spring segment is widened and the second document is moved in a second direction opposed to the first direction, the sleeve is rotated in a second rotating direction, so that the second spring segment is fixed on the rotating shaft and the first spring segment is twisted to generate a second damping torque. The first damping torque is greater than the second damping torque. The elastic element is disposed on the retard roller frame and contacted with the retard roller for providing an elastic force on the retard roller, so that the retard roller is movable upwardly and downwardly with respect to the retard roller frame.

In an embodiment, the sleeve inner wall includes a first inner wall part and a second inner wall part. The first inner wall part is near a first end of the sleeve, and has a first sleeve inner diameter. The second inner wall part is near a second end of the sleeve, and has a second sleeve inner diameter. The first sleeve inner diameter is smaller than the second sleeve inner diameter.

In an embodiment, the sleeve inner wall is an inclined wall.

In an embodiment, the first spring segment is contacted with the first inner wall part. The second spring segment is separated from the second inner wall part but contacted with the rotating shaft. When the sleeve is rotated in the first rotating direction, the first spring segment is twisted in the first rotating direction, and the first spring inner diameter of the first spring segment is widened, so that the first spring segment is fixed on the first inner wall part and the second spring segment is twisted with respect to the rotating shaft to generate the first damping torque. After the first spring inner diameter of the first spring segment is widened and the second document is moved in the second direction, the sleeve is rotated in the second rotating direction, so that the second spring segment is fixed on the rotating shaft and the first spring segment is twisted to generate the second damping torque.

In an embodiment, the first spring segment is eccentrically connected with the second spring segment.

In an embodiment, the retard roller further includes a receiving shaft inserted into the first end of the sleeve. The rotating shaft is inserted into the second end of the sleeve and received within the receiving shaft.

In an embodiment, the elastic element further includes a torsion spring arm, which is contacted with the retard roller for providing the elastic force on the retard roller, so that the retard roller is movable upwardly and downwardly with respect to the retard roller frame.

In an embodiment, the elastic element is a supporting torsion spring.

In an embodiment, the rotating shaft further comprises a confining edge. When the confining edge is fixed on the retard roller frame, the rotating shaft is fixed and fails to be rotated.

In accordance with a further aspect of the present invention, there is provided a retard roller module of an automatic document feeder. The retard roller module has a retard roller for providing a frictional force to separate a first document and a second document from each other. The first document lies on the second document. The retard roller module includes a retard roller frame, the retard roller and an elastic element. The retard roller is installed on the retard roller frame. The retard roller includes a first sleeve, a second sleeve, a separation pad, a helical spring, a one-way clutch and a rotating shaft. The first sleeve has a sleeve inner tube. The second sleeve is accommodated within the first sleeve, and has a sleeve outer tube. The sleeve outer tube is arranged at an end of the second sleeve and contacted with an end of the sleeve inner tube. The separation pad is sheathed around the first sleeve, and contacted with the second document. The helical spring is accommodated within the first sleeve. A first end of the helical spring is sheathed around the sleeve outer tube to define a first spring segment. A second end of the helical spring is sheathed around the sleeve inner tube to define a second spring segment. The first spring segment has a first spring inner diameter. The second spring segment has a second spring inner diameter smaller than the first spring inner diameter. The one-way clutch is accommodated within the second sleeve for preventing the second sleeve from rotating in a first rotating direction. The rotating shaft is penetrated through the first sleeve, the second sleeve and the one-way clutch. When the second document is moved in a first direction, the first sleeve is rotated in the first rotating direction, and the second sleeve fails to be rotated in response to the one-way clutch, so that the first spring segment is fixed on the sleeve outer tube and the second spring segment is twisted with respect to the sleeve inner tube to generate a first damping torque. When the second document is moved in a second direction opposed to the first direction, the first sleeve is rotated in a second rotating direction, the first spring segment is fixed on the sleeve outer tube, and the second spring segment is fixed on the sleeve inner tube, so that the second sleeve is rotated with the first sleeve and the one-way clutch is rotated with respect to the rotating shaft to generate a second damping torque. The first damping torque is greater than the second damping torque. The elastic element is disposed on the retard roller frame and contacted with the retard roller for providing an elastic force on the retard roller, so that the retard roller is movable upwardly and downwardly with respect to the retard roller frame.

In an embodiment, a tube diameter of the sleeve inner tube is smaller than that of the sleeve outer tube, so that the interference between the first spring segment and the sleeve outer tube is greater than the interference between the second spring segment and the sleeve inner tube.

In an embodiment, the rotating shaft further comprises a confining edge. When the confining edge is fixed on the retard roller frame, the rotating shaft is fixed and fails to be rotated.

In an embodiment, the elastic element further includes a torsion spring arm, which is contacted with the retard roller for providing the elastic force on the retard roller, so that the retard roller is movable upwardly and downwardly with respect to the retard roller frame.

In an embodiment, the elastic element is a supporting torsion spring.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
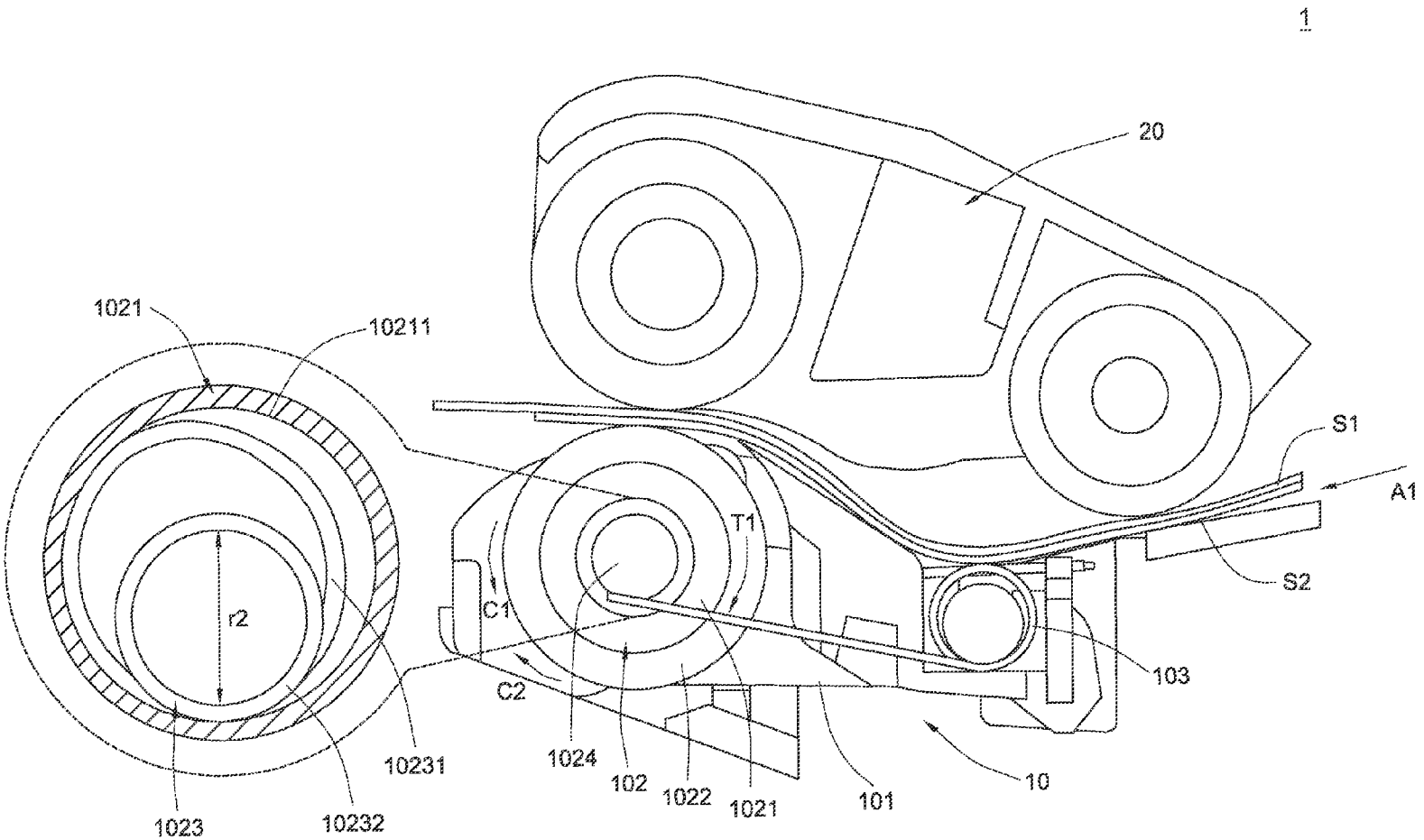
FIG. 1 is a schematic side view illustrating a retard roller module in a sheet-feeding status according to a first embodiment of the present invention.

The present invention provides a retard roller module for use in an automatic document feeder. FIG. 1 is a schematic side view illustrating a retard roller module in a sheet-feeding status according to a first embodiment of the present invention. The retard roller module is mounted in an automatic document feeder. As shown in FIG. 1, the automatic document feeder 1 comprises a retard roller module 10 and a sheet pick-up mechanism 20. The sheet pick-up mechanism 20 is used for feeding a first document S1 and a second document S2 into an internal portion of the automatic document feeder 1. The retard roller module 10 is used to provide a frictional force to the second document S2. Due to the frictional force, the first document S1 lying on the second document S2 could be separated from the second document S2.

Figure 2:
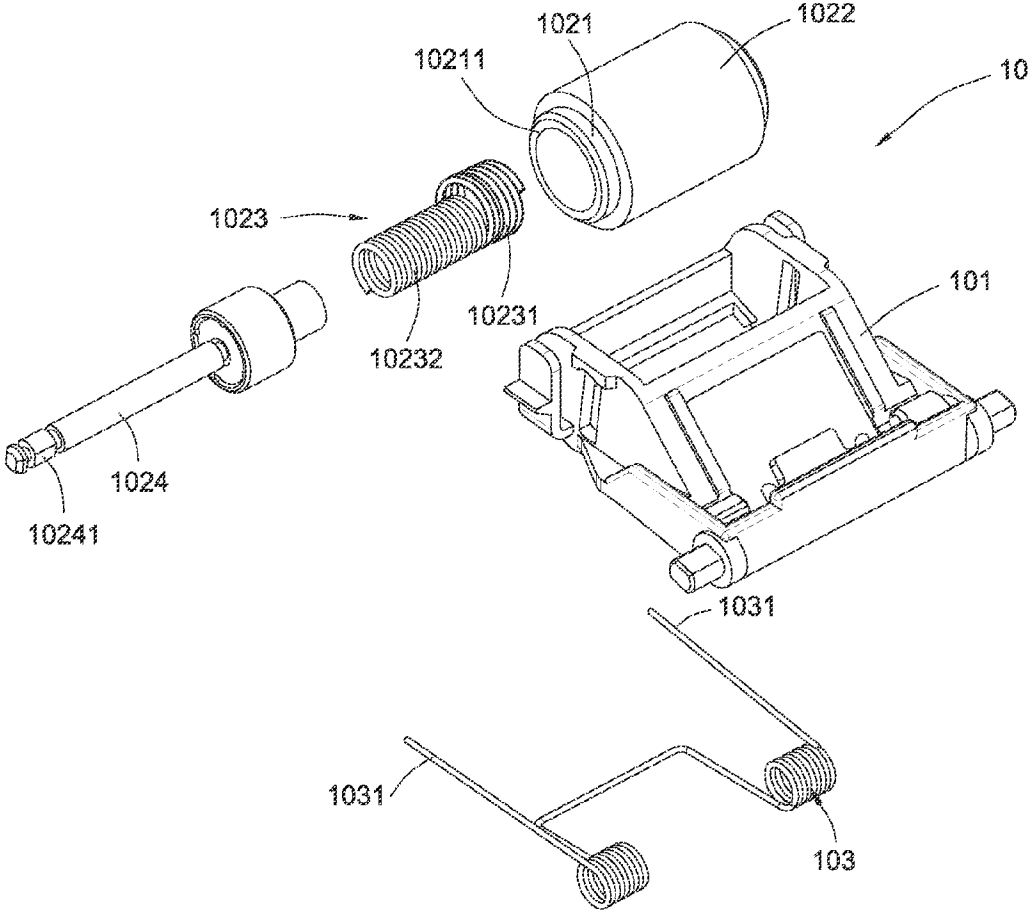
FIG. 2 is a schematic exploded view illustrating the retard roller module according to the first embodiment of the present invention.
Figure 3:
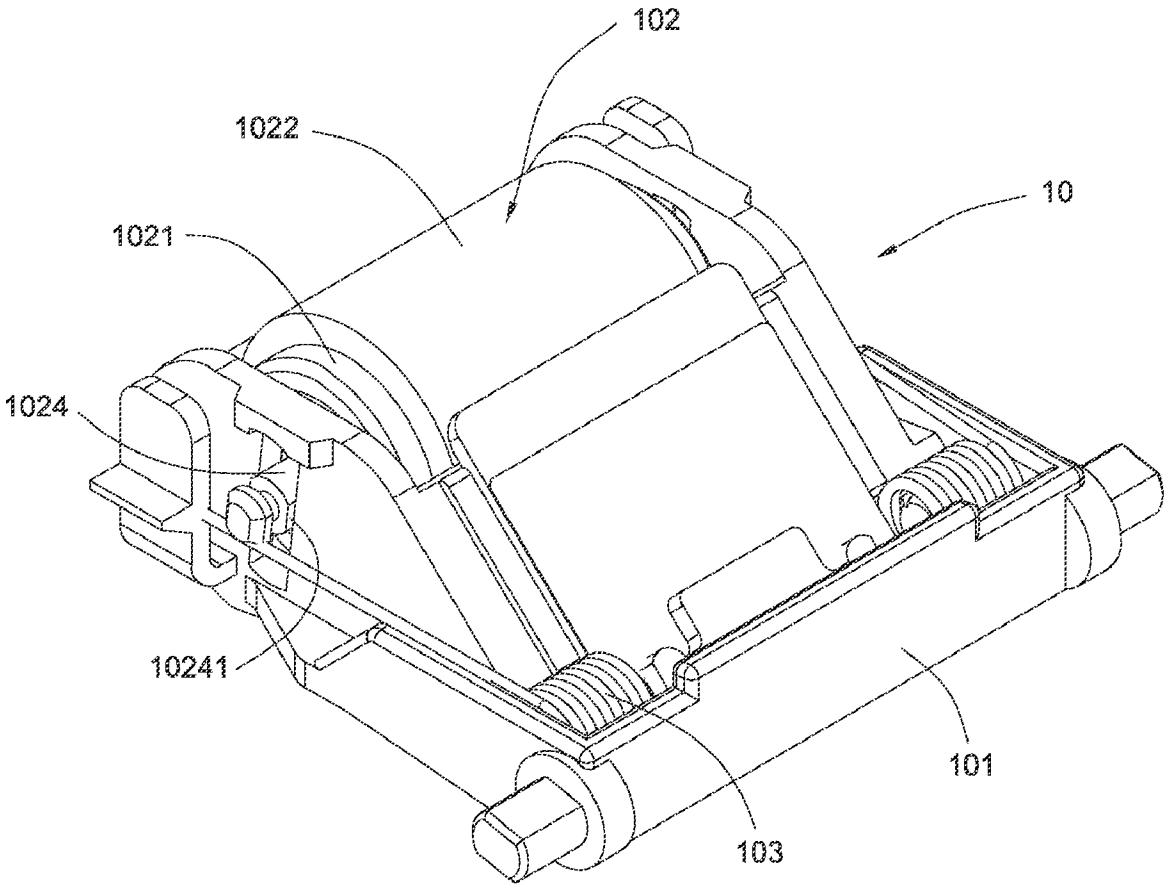
FIG. 3 is a schematic assembled view illustrating the retard roller module according to the first embodiment of the present invention.

Hereinafter, the configurations of the retard roller module 10 will be illustrated with reference to FIGS. 2 and 3. FIG. 2 is a schematic exploded view illustrating the retard roller module according to the first embodiment of the present invention. FIG. 3 is a schematic assembled view illustrating the retard roller module according to the first embodiment of the present invention. The retard roller module 10 comprises a retard roller frame 101, a retard roller 102 and an elastic element 103. The retard roller 102 is installed on the retard roller frame 101. The elastic element 103 is disposed on the retard roller frame 101. The elastic element 103 has a torsion spring arm 1031. The torsion spring arm 1031 is contacted with the retard roller 102 for providing an elastic normal force on the retard roller 102, so that the retard roller 102 is movable upwardly and downwardly with respect to the retard roller frame 101. In this embodiment, the elastic element 103 is a supporting torsion spring.

Figure 4:
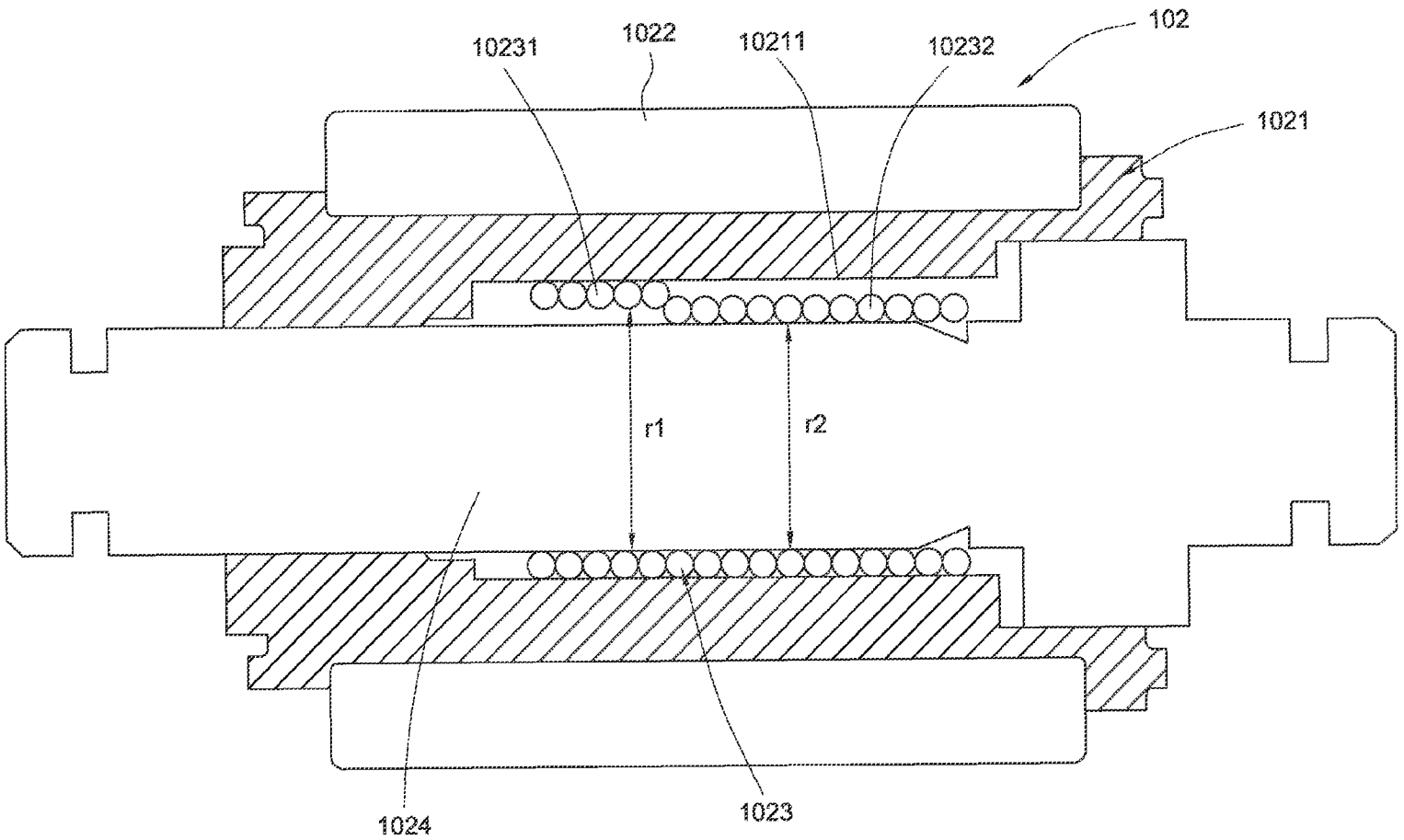
FIG. 4 is a schematic cross-sectional view illustrating the retard roller of the retard roller module according to the first embodiment of the present invention.

The configurations of the retard roller 102 will be illustrated in FIG. 4, which is a schematic cross-sectional view illustrating the retard roller of the retard roller module according to the first embodiment of the present invention. The retard roller 102, which is installed on the retard roller frame 101, comprises a sleeve 1021, a separation pad 1022, a helical spring 1023 and a rotating shaft 1024. The sleeve 1021 has a sleeve inner wall 10211. The separation pad 1022 is sheathed around the sleeve 1021. When the separation pad 1022 is contacted with the second document S2, a frictional force is generated. In this embodiment, the separation pad 1022 is a rubbery wheel. The helical spring 1023 is disposed within the sleeve 1021. The helical spring 1023 comprises a first spring segment 10231 and a second spring segment 10232. The first spring segment 10231 has a first spring inner diameter r1. The second spring segment 10232 has a second spring inner diameter r2. The first spring segment 10231 is contacted with the sleeve inner wall 10211. The second spring segment 10232 is separated from the sleeve inner wall 10211. The second spring inner diameter r2 is smaller than the first spring inner diameter r1. The first spring segment 10231 is eccentrically connected with the second spring segment 10232. The rotating shaft 1024 is penetrated through the helical spring 1023 and contacted with the supporting torsion spring 103 for receiving the elastic normal force, which is provided by the supporting torsion spring 103. The rotating shaft 1024 further comprises a confining edge 10241. When the confining edge 10241 is fixed on the retard roller frame 101, the rotating shaft 1024 is fixed and fails to be rotated (see FIGS. 2 and 3).

Please refer to FIG. 1 again. For feeding the first document S1 and the second document S2 by the automatic document feeder 1, the sheet pick-up roller and the sheet separation roller of the sheet pick-up mechanism 20 are rotated in a second rotating direction C2 to transport the first document S1 and the second document S2. As such, the first document S1 and the second document S2 are moved in a first direction A1. The separation pad 1022 of the retard roller 102 is contacted with the second document S2, so that the retard roller 102 is rotated in a first rotating direction C1. The first rotating direction C1 is opposed to the second rotating direction C2. In this embodiment, the first direction A1 is a sheet-feeding direction, the first rotating direction C1 is an anti-clockwise direction, and the second rotating direction C2 is a clockwise direction. When the first document S1 and the second document S2 are transported and moved in the first direction A1, the first document S1 and the second document S2 are sustained against the retard roller 102, so that the retard roller 102 is moved downwardly with respect to the retard roller frame 101. As such, the first document S1 and the second document S2 are allowed to be fed into the internal portion of the automatic document feeder 1 through the region between the sheet pick-up mechanism 20 and the retard roller module 10.

When the separation pad 1022 of the retard roller 102 is contacted with the second document S2 and the retard roller 102 is rotated in the first rotating direction C1, the sleeve 1021 of the retard roller 102 is also rotated in the first rotating direction C1. Since the first spring segment 10231 is contacted with the sleeve inner wall 10211, the first spring segment 10231 is twisted in the first rotating direction C1 upon rotation of the sleeve inner wall 10211. Due to the twisting direction of the helical spring 1023, the first spring segment 10231 is stretched. As such, the inner diameter of the first spring segment 10231 is widened to be larger than the original first spring inner diameter r1. As such, the gap between the first spring segment 10231 and the sleeve inner wall 10211 is shortened, and the interference between the first spring segment 10231 and the sleeve inner wall 10211 is increased, so that the first spring segment 10231 is fixed (tightened) on the sleeve inner wall 10211. At the same time, the second spring segment 10232 is twisted with respect to the rotating shaft 1024. In addition, for overcoming an inner stress resulted from the interference between the second spring segment 10232 and the rotating shaft 1024, the second spring segment 10232 generates a first damping torque T1. In response to the first damping torque T1, the retard roller 102 provides a first frictional force to the second document S2, so that the second document S2 fails to be transported. At the same time, the first document S1 is allowed to be transported in the first direction A1 by the sheet pick-up mechanism 20.

Figure 5:
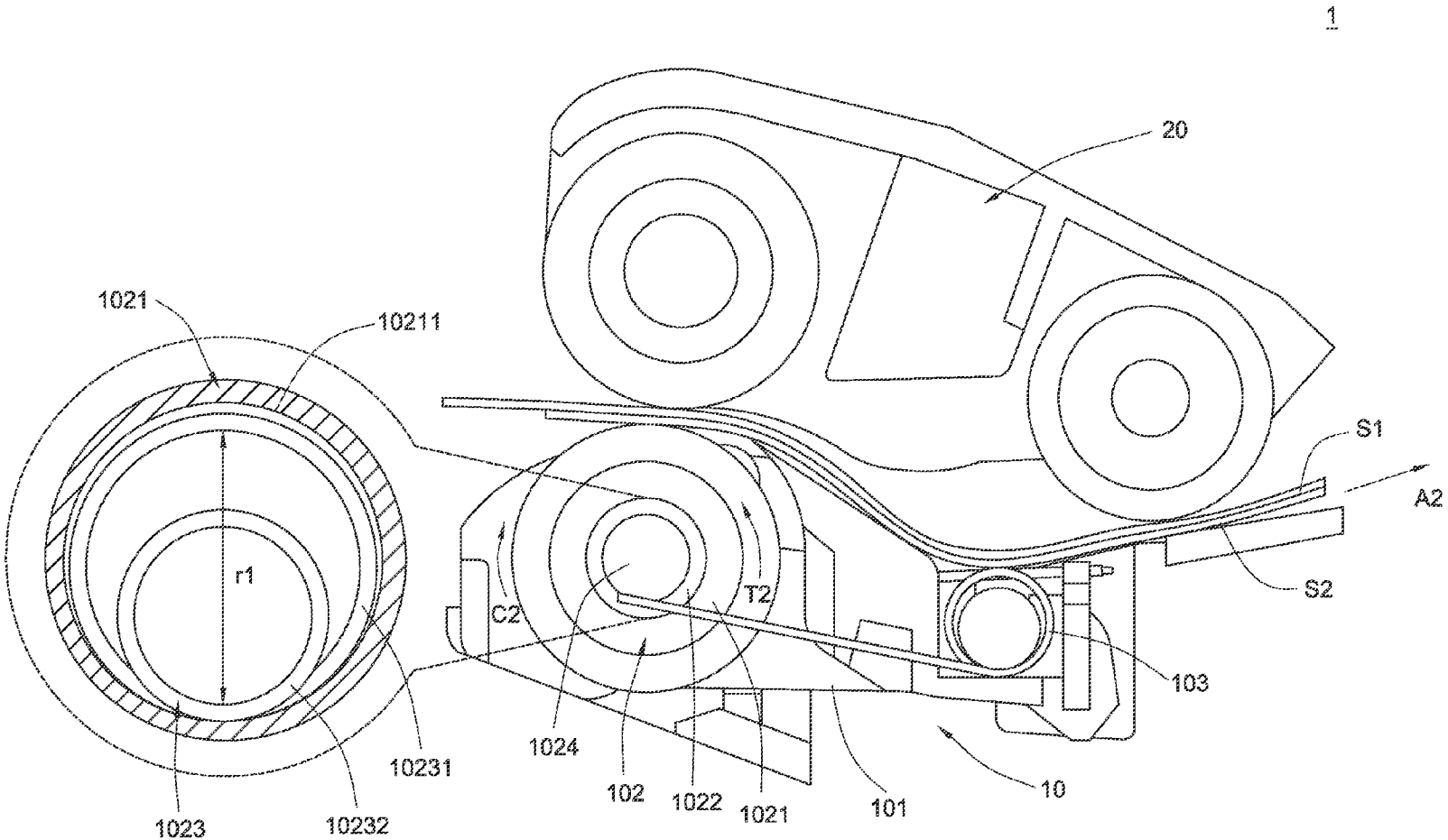
FIG. 5 is a schematic side view illustrating the retard roller module in a sheet-returning status according to the first embodiment of the present invention.

FIG. 5 is a schematic side view illustrating the retard roller module in a sheet-returning status according to the first embodiment of the present invention. In a case that the first document S1 is jammed in the internal portion of the automatic document feeder 1, the jammed first document S1 needs to be removed from the automatic document feeder 1. For removing the jammed first document S1, the jammed first document S1 needs to be moved in a second direction A2, which is opposed to the first direction A1. In this embodiment, the second direction A2 is a sheet-returning direction. When the first document S1 is moved in the second direction A2, the retard roller 102 is rotated in the second rotating direction C2 because the separation pad 1022 of the retard roller 102 is contacted with the second document S2. As such, the sleeve 1021 of the retard roller 102 is also rotated in the second rotating direction C2. Due to the twisting direction of the helical spring 1022, the second spring segment 10232 is fixed (tightened) on the rotating shaft 1024. Since the first spring segment 10231 is contacted with the sleeve inner wall 10211, the first spring segment 10231 is twisted in the second rotating direction C2 upon rotation of the sleeve inner wall 10211. In addition, for overcoming an inner stress resulted from the interference between the first spring segment 10231 and the sleeve inner wall 10211, the first spring segment 10231 generates a second damping torque T2. In response to the second damping torque T2, the retard roller 102 provides a second frictional force to the second document S2. Since the interference between the first spring segment 10231 and the sleeve inner wall 10211 is very low, the second damping torque T2 is very low. In other words, the second frictional force corresponding to the second damping torque T2 is also very low. Without obvious obstruction, the second document S2 could be smoothly moved in the second direction A2 to be removed from the automatic document feeder 1.

It is noted that the damping torque is in direct proportion to the frictional force. As the first damping torque T1 is increased, the first frictional force is increased. Whereas, as the second damping torque T2 is decreased, the second frictional force is decreased.

Figure 6A:
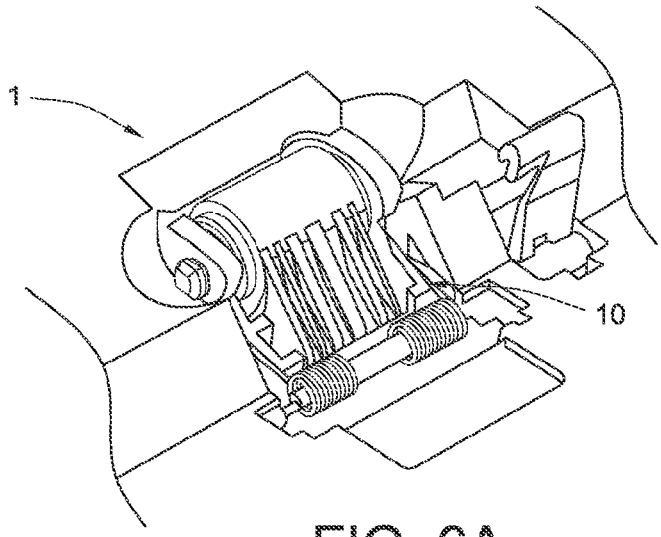
FIGS. 6A, 6B and 6C are schematic views illustrating the process of disassembling/assembling the retard roller module according to the first embodiment of the present invention.
Figure 6B:
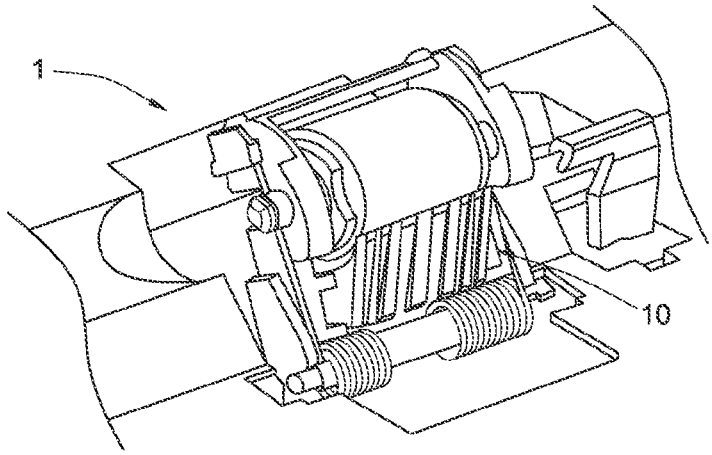
Figure 6C:
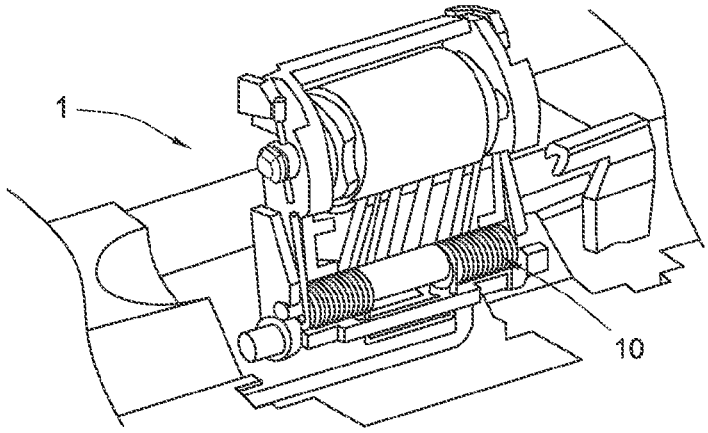

FIGS. 6A, 6B and 6C are schematic views illustrating the process of disassembling/assembling the retard roller module according to the first embodiment of the present invention. For disassembled the retard roller module 10 from the automatic document feeder 1, the bilateral sides of the retard roller 102 are firstly held by the user's hands, then the retard roller module 10 is turned, and finally the retard roller module 10 is detached. On the other hand, the user may assemble the retard roller module 10 in the automatic document feeder 1 in the sequence of the steps shown in FIG. 6C, FIG. 6B and FIG. 6A.

Figure 7:
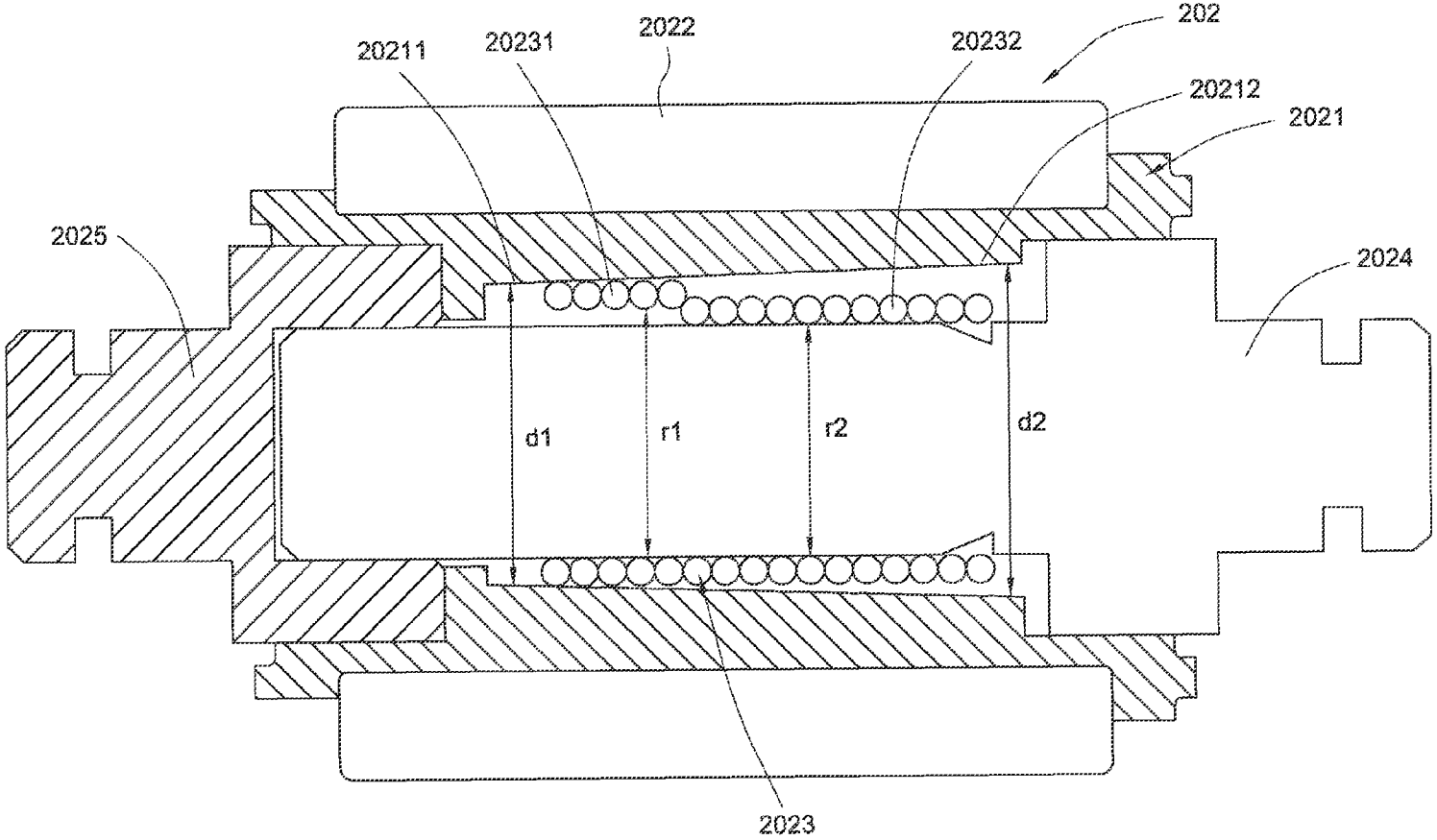
FIG. 7 is a schematic cross-sectional view illustrating the retard roller of the retard roller module according to a second embodiment of the present invention.

Another exemplary retard roller and another exemplary retard roller assembly will be illustrated with reference to FIG. 7. FIG. 7 is a schematic cross-sectional view illustrating the retard roller of the retard roller module according to a second embodiment of the present invention. Except for the retard roller, the configurations of the other components included in the automatic document feeder of this embodiment are similar to those illustrated in the first embodiment, and are not redundantly described herein. As shown in FIG. 7, the retard roller 202 comprises a sleeve 2021, a separation pad 2022, a helical spring 2023, a rotating shaft 2024 and a receiving shaft 2025. The sleeve 2021 comprises a first inner wall part 20211 and a second inner wall part 20212. The first inner wall part 20211 has a first sleeve inner diameter d1. The first inner wall part 20211 is near a first end of the sleeve 2021. The second inner wall part 20212 has a second sleeve inner diameter d2. The second inner wall part 20212 is near a second end of the sleeve 2021. The first sleeve inner diameter d1 is smaller than the second sleeve inner diameter d2. The inner wall of the sleeve 2021 is an inclined wall. That is, the inner wall of the sleeve 2021 is cone-shaped wall.

The separation pad 2022 is sheathed around the sleeve 2021. When the separation pad 2022 is contacted with the second document S2, a frictional force is generated. In this embodiment, the separation pad 2022 is a rubbery wheel. The helical spring 2023 is disposed within the sleeve 2021. The helical spring 2023 comprises a first spring segment 20231 and a second spring segment 20232. The first spring segment 20231 has a first spring inner diameter r1. The second spring segment 20232 has a second spring inner diameter r2. The first spring segment 20231 is contacted with the sleeve inner wall 20211. The second spring segment 20232 is separated from the sleeve inner wall 20211. The second spring inner diameter r2 is smaller than the first spring inner diameter r1. The first spring segment 20231 is eccentrically connected with the second spring segment 20232. The rotating shaft 2024 is penetrated through the helical spring 2023 and inserted into the second end of the sleeve 2021. The receiving shaft 2025 is inserted into the first end of the sleeve 2021 for receiving the rotating shaft 2024.

Hereinafter, the operating principles of the retard roller 202 when the automatic document feeder is in the sheet-feeding status will be illustrated in more details. Except for the retard roller, the operating principles of the other components included in the automatic document feeder of this embodiment are similar to those illustrated in the first embodiment, and are not redundantly described herein. When the first document and the second document are fed, the separation pad 2022 of the retard roller 202 is contacted with the second document. As such, the retard roller 202 is rotated in the first rotating direction, and the sleeve 2021 of the retard roller 202 is also rotated in the first rotating direction. Since the first spring segment 20231 is contacted with the first inner wall part 20211, the first spring segment 20231 is twisted in the first rotating direction upon rotation of the first inner wall part 20211. Due to the twisting direction of the helical spring 2022, the first spring segment 20231 is stretched. As such, the first spring segment 20231 is fixed on the first inner wall part 20211. At the same time, the second spring segment 20232 is twisted with respect to the rotating shaft 2024. In addition, for overcoming an inner stress resulted from the interference between the second spring segment 20232 and the rotating shaft 2024, the second spring segment 10232 generates a first damping torque. In response to the first damping torque, the retard roller 202 provides a first frictional force to the second document, so that the second document fails to be transported. At the same time, the first document is allowed to be transported in the first direction by the sheet pick-up mechanism 20.

In a case that the first document is jammed in the internal portion of the automatic document feeder, the jammed first document needs to be removed from the automatic document feeder. For removing the jammed first document, the jammed first document needs to be moved in a second direction, which is opposed to the first direction. When the first document is moved in the second direction, the retard roller 202 is rotated in the second rotating direction opposed to the first rotating direction because the separation pad 2022 of the retard roller 202 is contacted with the second document. As such, the sleeve 2021 of the retard roller 202 is also rotated in the second rotating direction. Due to the twisting direction of the helical spring 2022, the second spring segment 20232 is fixed (tightened) on the rotating shaft 2024. Since the first spring segment 20231 is contacted with the sleeve inner wall 20211, the first spring segment 20231 is twisted in the second rotating direction upon rotation of the first inner wall part 20211. In addition, for overcoming an inner stress resulted from the interference between the first spring segment 20231 and the first inner wall part 20211, the first spring segment 20231 generates a second damping torque T2. In response to the second damping torque T2, the retard roller 202 provides a second frictional force to the second document. The second frictional force is nearly zero. As such, the second document could be smoothly moved in the second direction to be removed from the automatic document feeder without obvious obstruction.

In this embodiment, the sleeve 2021 comprises a first inner wall part 20211 and a second inner wall part 20212. The inner wall of the sleeve 2021 is substantially an inclined wall. Since the first inner wall part 20211 of the sleeve 2021 is gradually tapered, the interference between the first inner wall part 20211 and the first spring segment 20231 within the sleeve 2021 becomes more uniform. In other words, the damping torque is generated more smoothly and stably.

Figure 8:
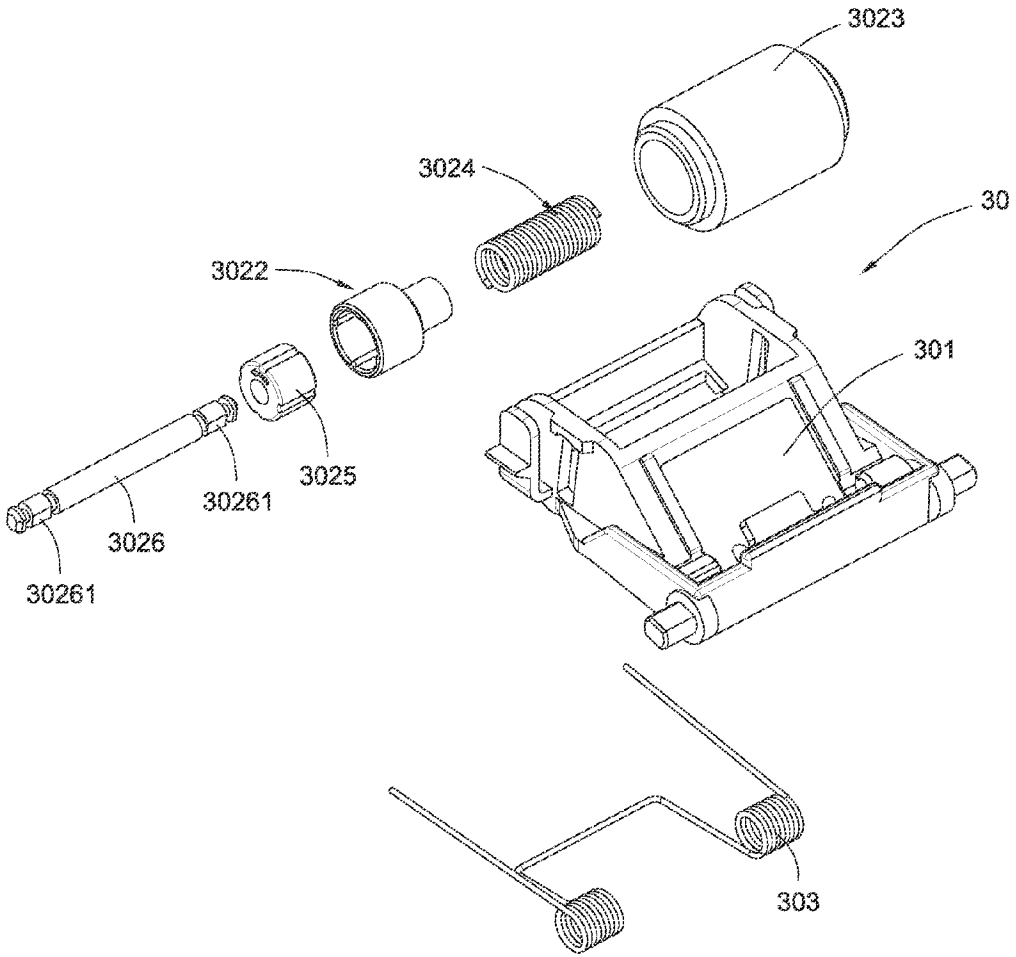
FIG. 8 is a schematic exploded view illustrating the retard roller module according to a third embodiment of the present invention.
Figure 9:
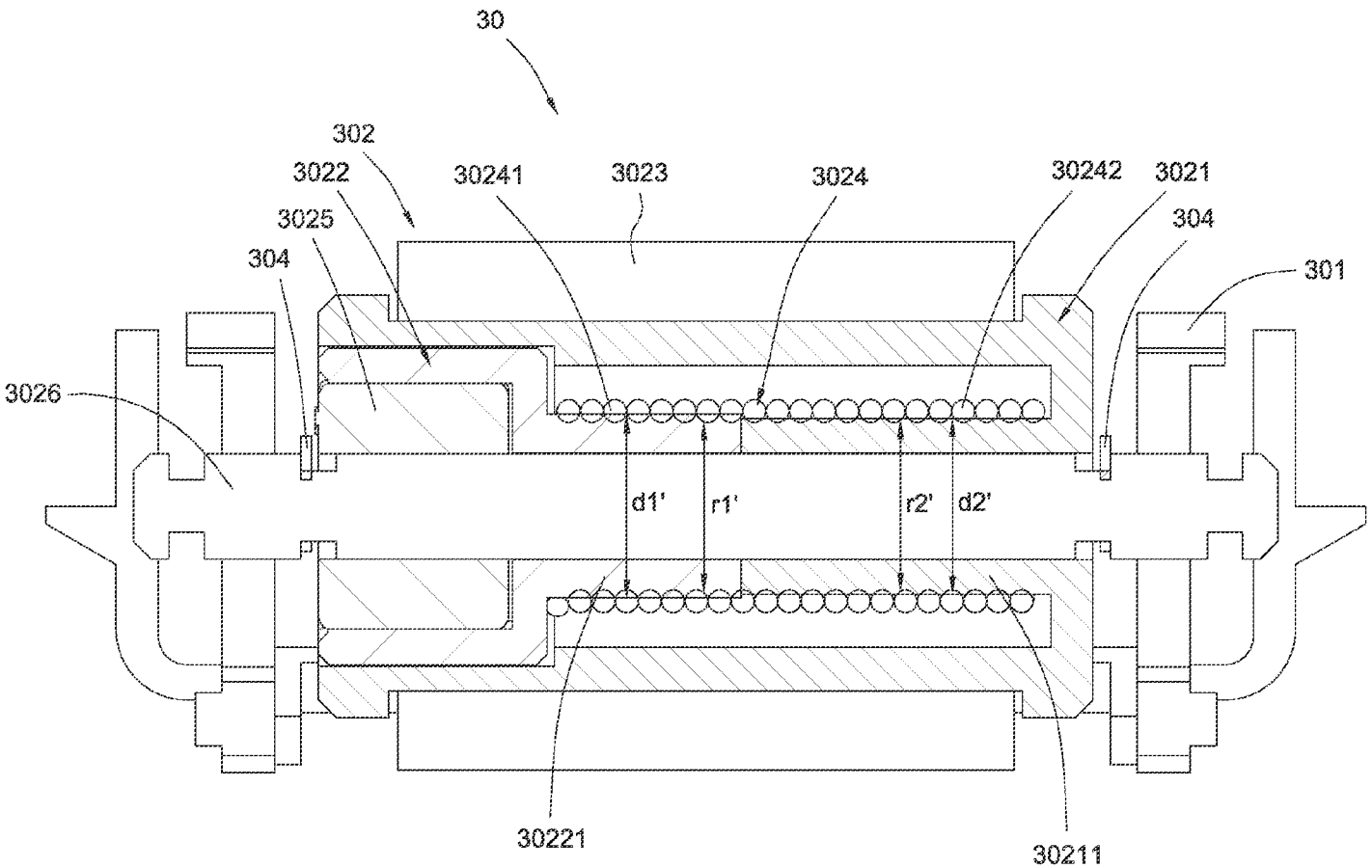
FIG. 9 is a schematic cross-sectional view illustrating the retard roller module according to the third embodiment of the present invention.

A more preferred embodiment is illustrated with reference to FIGS. 8 and 9. FIG. 8 is a schematic exploded view illustrating the retard roller module according to a third embodiment of the present invention. FIG. 9 is a schematic cross-sectional view illustrating the retard roller module according to the third embodiment of the present invention. The retard roller module 30 comprises a retard roller frame 301, a retard roller 302 and an elastic element 303. The retard roller 302 is installed on the retard roller frame 301. The elastic element 303 is disposed on the retard roller frame 301, and contacted with the retard roller 302. The elastic element 303 is used for providing an elastic normal force on the retard roller 302, so that the retard roller 302 is movable upwardly and downwardly with respect to the retard roller frame 301. In this embodiment, the elastic element 303 is a supporting torsion spring. The structure of the retard roller 302 will be illustrated as follows. The retard roller 302 comprises a first sleeve 3021, a second sleeve 3022, a separation pad 3023, a helical spring 3024, a one-way clutch 3025 and a rotating shaft 3026. The first sleeve 3021 has a sleeve inner tube 30211. The second sleeve 3022 is accommodated within the first sleeve 3021. The second sleeve 3022 has a sleeve outer tube 30221. The sleeve outer tube 30221 is arranged at an end of the second sleeve 3022, and contacted with an end of the sleeve inner tube 30211. The tube diameter d2' of the sleeve inner tube 30211 is smaller than the tube diameter d1' of the sleeve outer tube 30221. As such, the interference between the first spring segment 30241 and the sleeve outer tube 30221 is greater than the interference between the second spring segment 30242 and the sleeve inner tube 30211.

The separation pad 3022 is sheathed around the first sleeve 3021. When the separation pad 3022 is contacted with the second document S2, a frictional force is generated. In this embodiment, the separation pad 3022 is a rubbery wheel. The helical spring 3024 is disposed within the first sleeve 3021. An end of the helical spring 3024 is sheathed around the sleeve outer tube 30221 to define a first spring segment 30241. The other end of the helical spring 3024 is sheathed around the sleeve inner tube 30211 to define a second spring segment 30242. The first spring segment 30241 has a first spring inner diameter r1'. The second spring segment 30242 has a second spring inner diameter r2', which is smaller than the first spring inner diameter r1'. The one-way clutch 3025 is accommodated within the second sleeve 3022 for preventing the second sleeve 3022 from rotating in the first rotating direction. That is, due to the one-way clutch 3025, the second sleeve 3022 is allowed to be rotated in the second rotating direction. The rotating shaft 3026 is penetrated through the first sleeve 3021, the second sleeve 3022 and the one-way clutch 3025. The rotating shaft 3026 further comprises a confining edge 30261. When the confining edge 30261 is fixed on the retard roller frame 301, the rotating shaft 3026 is fixed and fails to be rotated.

The operating principles of the retard roller module will be illustrated as follows. For feeding the first document (not shown) and the second document (not shown) by the automatic document feeder, the sheet pick-up mechanism (not shown) is rotated in a second rotating direction to transport the first document and the second document. As such, the first document and the second document are moved in a first direction (not shown). When the first document and the second document are transported and moved in the first direction, the first document and the second document are sustained against the retard roller 302, so that the retard roller 302 is moved downwardly with respect to the retard roller frame 301. When the separation pad 3022 of the retard roller 302 is contacted with the second document and the retard roller 302 is rotated in the first rotating direction, the first sleeve 3021 is also rotated in the first rotating direction. Due to the one-way clutch 3025, the second sleeve 3022 fails to be rotated, so that the first spring segment 30241 is fixed on the sleeve outer tube 30221. In addition, the second spring segment 30242 is twisted with respect to the sleeve inner tube 30211 to generate a first damping torque. In response to the first damping torque, the retard roller 302 provides a first frictional force to the second document, so that the second document fails to be moved. At the same time, the first document is allowed to be transported in the first direction.

In a case that the first document is jammed in the internal portion of the automatic document feeder, the jammed first document needs to be removed from the automatic document feeder. For removing the jammed first document, the jammed first document needs to be moved in a second direction, which is opposed to the first direction. When the first document is moved in the second direction, the retard roller 302 is rotated in the second rotating direction because the separation pad 3022 of the retard roller 302 is contacted with the second document. As such, the first sleeve 3021 is also rotated in the second rotating direction. The first spring segment 30241 is fixed on the sleeve outer tube 30221, and the second spring segment 30242 is fixed on the sleeve inner tube 30211. The second sleeve 3022 is rotated with the first sleeve 3021. In addition, the one-way clutch 3025 is rotated with respect to the rotating shaft 3026, so that a second damping torque is generated. The first damping torque is greater than the second damping torque. Since the one-way clutch 3025 is smoothly rotated with respect to the rotating shaft 3026, the interference between the one-way clutch 3025 and the rotating shaft 3026 is nearly zero. In other words, the second damping torque is nearly zero, and the second frictional force corresponding to the second damping torque is nearly zero. As such, the second document could be smoothly moved in the second direction to be removed from the automatic document feeder without obvious obstruction.

From the above description, since the helical spring of the retard roller of the present invention comprises a first spring segment with a larger inner diameter and a second spring segment with a smaller inner diameter, different interference magnitudes are generated by the first spring segment and the second spring segment when the helical spring is twisted. In response to different interference magnitudes, the first damping torque and the second damping torque with different torque magnitudes are generated, wherein the first damping torque is greater than the second damping torque. By mean of the above configurations, the retard roller of the present invention can provides two damping torques with different directions and different magnitudes. In a case that the document is jammed in the automatic document feeder, the automatic document feeder is capable of returning the document in the sheet-returning direction to remove the document without the need of opening the upper cover.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A retard roller module of an automatic document feeder, said retard roller module having a retard roller for providing a frictional force to separate a first document and a second document from each other, said first document lying on said second document, said retard roller module comprising:

a retard roller frame;

said retard roller installed on said retard roller frame, said retard roller comprising:

a sleeve having a sleeve inner wall;

a separation pad sheathed around said sleeve, and contacted with said second document;

a helical spring disposed within said sleeve, and comprising a first spring segment and a second spring segment, wherein said first spring segment has a first spring inner diameter, said second spring segment has a second spring inner diameter smaller than said first spring inner diameter, and said first spring segment is contacted with said sleeve inner wall; and a rotating shaft penetrated through said helical spring and contacted with said second spring segment, wherein when said second document is moved in a first direction, said sleeve is rotated in a first rotating direction, said first spring segment is twisted in said first rotating direction, and said first spring inner diameter of said first spring segment is widened, so that said first spring segment is fixed on said sleeve inner wall and said second spring segment is twisted with respect to said rotating shaft to generate a first damping torque, wherein said first spring inner diameter of said first spring segment is widened and said second document is moved in a second direction opposed to said first direction, thereafter said sleeve is rotated in a second rotating direction, so that said second spring segment is fixed on said rotating shaft and said first spring segment is twisted to generate a second damping torque, wherein said first damping torque is greater than said second damping torque; and an elastic element disposed on said retard roller frame and contacted with said retard roller for providing an elastic force on said retard roller, so that said retard roller is movable upwardly and downwardly with respect to said retard roller frame.

2. The retard roller module according to claim 1 wherein said first spring segment is eccentrically connected with said second spring segment.

3. The retard roller module according to claim 1 wherein said retard roller further comprises a receiving shaft inserted into a first end of the sleeve, wherein said rotating shaft is inserted into a second end of said sleeve and received within said receiving shaft.

4. The retard roller module according to claim 1 wherein said elastic element further comprises a torsion spring arm, which is contacted with said retard roller for providing said elastic force on said retard roller, so that said retard roller is movable upwardly and downwardly with respect to said retard roller frame.

5. The retard roller module according to claim 4 wherein said elastic element is a supporting torsion spring.

6. The retard roller module according to claim 1 wherein said rotating shaft further comprises a confining edge, wherein when said confining edge is fixed on said retard roller frame, said rotating shaft is fixed and fails to be rotated.

* * * * *